US010697053B2

(12) United States Patent
Nakano et al.

(10) Patent No.: US 10,697,053 B2
(45) Date of Patent: Jun. 30, 2020

(54) METHOD FOR MANUFACTURING BLACK PLATED STEEL SHEET, APPARATUS FOR MANUFACTURING BLACK PLATED STEEL SHEET, AND SYSTEM FOR MANUFACTURING BLACK PLATED STEEL SHEET

(71) Applicant: NISSHIN STEEL CO., LTD., Tokyo (JP)

(72) Inventors: Tadashi Nakano, Osaka (JP); Shin Ueno, Osaka (JP); Masaya Yamamoto, Osaka (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 16/081,962

(22) PCT Filed: Aug. 9, 2016

(86) PCT No.: PCT/JP2016/073386
§ 371 (c)(1),
(2) Date: Sep. 4, 2018

(87) PCT Pub. No.: WO2017/149800
PCT Pub. Date: Sep. 8, 2017

(65) Prior Publication Data

US 2019/0062889 A1 Feb. 28, 2019

(30) Foreign Application Priority Data

Mar. 1, 2016 (JP) ..... 2016-038848

(51) Int. Cl.
*C23C 2/26* (2006.01)
*C23C 2/06* (2006.01)
(Continued)

(52) U.S. Cl.
CPC ..... *C23C 2/26* (2013.01); *C22C 18/00* (2013.01); *C22C 18/04* (2013.01); *C22C 21/10* (2013.01);
(Continued)

(58) Field of Classification Search
None
See application file for complete search history.

(56) References Cited

U.S. PATENT DOCUMENTS 4,448,612 A * 5/1984 Ebert ..... H01J 9/146 148/287
2013/0068350 A1 3/2013 Steins et al.
(Continued)

FOREIGN PATENT DOCUMENTS

DE 2727111 A1 * 12/1978 ..... C23C 8/16
DE 3444038 A1 * 6/1986 ..... C21D 9/673
(Continued)

OTHER PUBLICATIONS

DE 2727111 machine translation (Year: 1978).*
(Continued)

*Primary Examiner* — Paul A Wartalowicz
*Assistant Examiner* — Stephani Hill
(74) *Attorney, Agent, or Firm* — Brundidge & Stanger, P.C.

(57) ABSTRACT

The purpose of the present invention is to provides a method for manufacturing a black plated steel sheet that is capable of more evenly blackening the area of the plated steel sheet to be blackened. The present invention relates to a method for manufacturing a black plated steel sheet by bringing a plated steel sheet with an Al- and Mg-containing hot-dip galvanized layer into contact with water vapor inside a sealed vessel. This method performs, in the following order: a first step for heating a plated steel sheet disposed inside a
(Continued)

sealed vessel in the presence of a gas, the dew point of which is always less than the plated steel sheet temperature; a second step for evacuating the heated ambient gas inside the sealed vessel to make the pressure of the gas inside the sealed vessel to be 70 kPa or less; and a third step for introducing water vapor inside the sealed vessel in which the pressure of the gas therein has been reduced to 70 kPa or less to blacken the galvanized layer.

12 Claims, 4 Drawing Sheets

(51) Int. Cl.

| | |
|---|---|
| ***C23C 2/40*** | (2006.01) |
| ***C22C 18/04*** | (2006.01) |
| ***C22C 18/00*** | (2006.01) |
| ***C23C 2/28*** | (2006.01) |
| ***C23C 8/16*** | (2006.01) |
| ***C22C 21/10*** | (2006.01) |

(52) U.S. Cl.
CPC ..... *C23C 2/06* (2013.01); *C23C 2/28* (2013.01); *C23C 2/40* (2013.01); *C23C 8/16* (2013.01)

(56) References Cited

U.S. PATENT DOCUMENTS

| | | | | |
|---|---|---|---|---|
| 2015/0072166 | A1* | 3/2015 | Nakano ..... | B32B 15/095 428/623 |
| 2015/0083276 | A1 | 3/2015 | Nakano et al. | |
| 2015/0107722 | A1 | 4/2015 | Nakano et al. | |

FOREIGN PATENT DOCUMENTS

| | | | | |
|---|---|---|---|---|
| JP | 64-056881 | A | | 3/1989 |
| JP | 2012-132061 | A | | 7/2012 |
| JP | 2012132061 | A | * | 7/2012 |
| JP | 2013-241655 | A | | 12/2013 |
| JP | 2013-241676 | A | | 12/2013 |
| WO | 2013/161268 | A1 | | 10/2013 |
| WO | 2013/161269 | A1 | | 10/2013 |
| WO | WO-2013160973 | A1 | * | 10/2013 |

OTHER PUBLICATIONS

JP 2012-132061 machine translation (Year: 2012).*
DE 3444038 machine translation (Year: 1986).*
International Search Report from International Application No. PCT/JP2016/073386 dated Sep. 27, 2016.

* cited by examiner

METHOD FOR MANUFACTURING BLACK PLATED STEEL SHEET, APPARATUS FOR MANUFACTURING BLACK PLATED STEEL SHEET, AND SYSTEM FOR MANUFACTURING BLACK PLATED STEEL SHEET

TECHNICAL FIELD

The present invention relates to a method for producing a black-plated steel sheet, an apparatus for producing the black-plated steel sheet, and a system for producing the black-plated steel sheet.

BACKGROUND ART

In the fields, such as roofing materials and exterior materials of buildings, home appliances and automobiles, the demand for steel sheets having black appearance is increasing from the viewpoints of, for example, design. For blackening the surface of a steel sheet, a method may be employed, which applies a black coating material to the surface of the steel sheet to form a black coating film. In the fields described above, steel sheets with plating, such as hot-dip Zn-plating, hot-dip Al-containing Zn-plating, and hot-dip Al and Mg-containing Zn-plating are used in many cases from the viewpoint of corrosion resistance. These plated steel sheets however have a metallic gloss surface with silver gray color. Accordingly, in order to obtain black appearance of high quality design by application of a black coating material, a thick coating film is required to conceal the color of the plated steel sheet, thereby increasing coating costs. Furthermore, the thick coating film precludes resistance welding, such as spot welding, which poses another disadvantage.

For concealing the metallic gloss and silver gray color of a plated steel sheet without forming of a black coating film, a method for blackening a plating layer itself by oxidizing the same is proposed. PTL 1, for example, discloses a method for forming a oxide layer by bringing a hot-dip Al and Mg-containing Zn-plated steel sheet (hereinafter, also simply referred to as a "plated steel sheet") into contact with water vapor inside a closed vessel to blacken a hot-dip Al and Mg-containing Zn-plating layer (hereinafter, also simply referred to as a "plating layer"). Hereinafter, bringing a plated steel sheet into contact with water vapor for blackening is also simply referred to as "water vapor treatment" or "treating with water vapor."

PTL 2 discloses a method for treating plated steel sheets with water vapor by disposing a spacer between the plated steel sheets. The method of PTL 2 is capable of more uniformly blackening of the plating layer surface, as disposition of a spacer between plated steel sheets enables water vapor to contact the plated steel sheets at the periphery and center thereof in the same degree.

CITATION LIST

Patent Literature

PTL 1

Japanese Patent Application Laid-Open No. 2013-241655

PTL 2

Japanese Patent Application Laid-Open No. 2013-241676

SUMMARY OF INVENTION

Technical Problem

For blackening a plating layer more uniformly as disclosed in PTL 2, it is preferred to allow water vapor to satisfactorily spread to cover the entire region to be blackened in the plated steel sheet, thereby treating the region more uniformly with the water vapor.

The present inventors have analyzed the conditions of water vapor treatment in more detail for obtaining more beautiful appearance of a plated steel sheet by allowing water vapor to more satisfactorily spread to cover the entire region to be blackened in the plated steel sheet to blacken a plating layer more uniformly.

The present invention is completed on the basis of the above analysis, and a purpose of the present invention is to provide a method for producing a black-plated steel sheet, in which a region to be blackened in the plated steel sheet can be more uniformly blackened, and to provide an apparatus and a system used in such a method.

Solution to Problem

The present invention relates to a method which brings, inside a closed vessel, a plated steel sheet including a base steel sheet and a hot-dip Al and Mg-containing Zn-plating layer formed on the surface of the base steel sheet into contact with water vapor to produce a black-plated steel sheet. The method of the present invention is performed in the following order of steps 1 to 3: (step 1) heating the plated steel sheet disposed inside the closed vessel in the presence of a gas having a dew point which is always lower than the temperature of the plated steel sheet; (step 2) reducing the gas pressure inside the closed vessel to 70 kPa or less by exhausting the atmospheric gas, which is heated, inside the closed vessel; and (step 3) blackening the plating layer by introducing water vapor into the closed vessel having the inside gas pressure of 70 kPa or less.

The present invention also relates to an apparatus for producing a black-plated steel sheet. The apparatus of the present invention includes a closed vessel including a disposition section where a plated steel sheet including a base steel sheet and a hot-dip Al and Mg-containing Zn-plating layer formed on the surface of the base steel sheet can be disposed; a heating section for heating the inside of the closed vessel; an exhaust section for exhausting the atmospheric gas inside the closed vessel to reduce the gas pressure inside the closed vessel to 70 kPa or less; and a water vapor introducing section for introducing water vapor into the closed vessel.

The present invention also relates to a system for producing a black-plated steel sheet. The system of the present invention includes the apparatus of the present invention; and a control section for controlling the operations of the heating section, the exhaust section and the water vapor introducing section to bring, inside the closed vessel, the plated steel sheet (the disposition section of the closed vessel is where the plated steel sheet is disposed) into contact with water vapor, thereby producing a black-plated steel sheet.

Advantageous Effects of Invention

The present invention provides a method for producing a black-plated steel sheet, in which a region to be blackened in a plated steel sheet can be more uniformly blackened, and an apparatus and a system used in such a method.

DESCRIPTION OF EMBODIMENTS

1. Method for Producing Black-Plated Steel Sheet

A method according to the present invention for producing a black-plated steel sheet (hereinafter, also simply referred to as a "method of the present invention") produces a black-plated steel sheet by bringing, inside a closed vessel, a hot-dip Al and Mg-containing Zn-plated steel sheet that contains Al and Mg into contact with water vapor.

Figure 1:
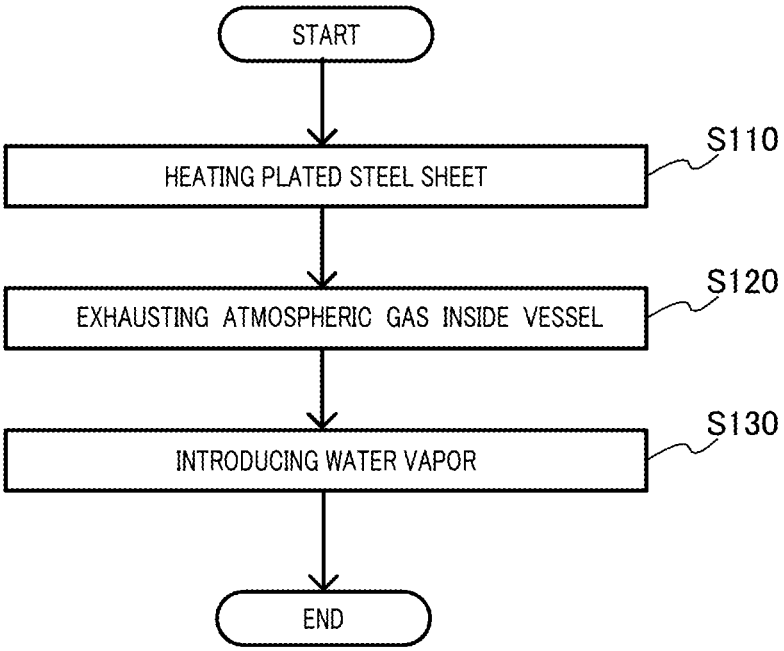
FIG. 1 is a flowchart for a mode of a method according to the present invention for producing a black-plated steel sheet.
Figure 2:
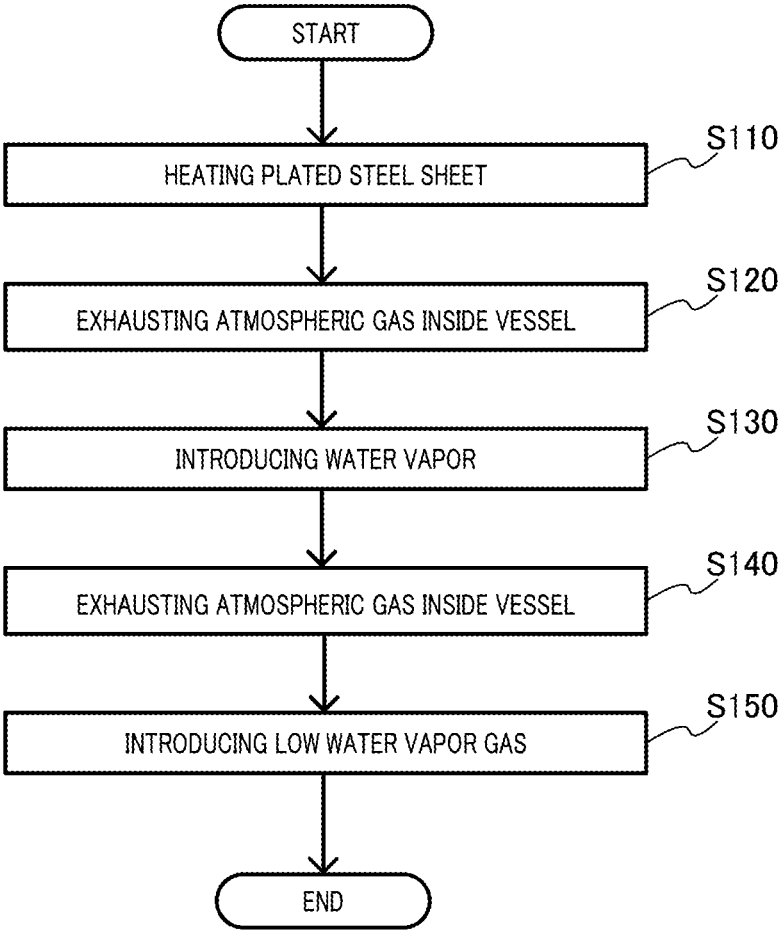
FIG. 2 is a flowchart for another mode of the method according to the present invention for producing a black-plated steel sheet.

The method of the present invention is performed as illustrated in FIG. 1, in the following order of steps 1 to 3: (step 1: S110) heating a hot-dip Al and Mg-containing Zn-plated steel sheet disposed inside a closed vessel in the presence of a gas having a dew point which is always lower than the temperature of the plated steel sheet (hereinafter, also simply referred to as a "low water vapor gas"); (step 2: S120) exhausting the atmospheric gas inside the closed vessel to reduce the gas pressure inside the closed vessel to 70 kPa or less; and (step 3: S130) introducing water vapor into the closed vessel to blacken a plating layer of the plated steel sheet. The method of the present invention may be further performed as illustrated in FIG. 2, after the step 3 (S130), in the following order of steps 4 and 5: (step 4: S140) exhausting the atmospheric gas inside the closed vessel to reduce the gas pressure inside the closed vessel to 70 kPa or less; and (step 5: S150) introducing into the closed vessel a gas having a dew point which is always lower than the temperature of the plated steel sheet ("low water vapor gas") to cool the plated steel sheet. An atmospheric gas refers to the gases inside a closed vessel, and to a collective term of air, water vapor, hydrogen-containing water vapor and a low water vapor gas which are described herein.

In the following, each step will be described in more detail.

(Step 1)

In Step 1 (S110), a plated steel sheet disposed inside a closed vessel is heated in the presence of a low water vapor gas.

The closed vessel includes a disposition section where a plated steel sheet is to be disposed, and has a sufficient strength for enduring the inside gas pressure reduction due to the exhausting of the atmospheric gas, water vapor introduction, heating, cooling, and the like. The closed vessel is configured so that it can be in both a closed state and an opened state. In the closed state, it is substantially impossible for a gas to flow in from the outside to the inside of the closed vessel, or to flow out from the inside to the outside thereof. In the opened state, a plated steel sheet can be conveyed from the outside into the inside of the closed vessel. The closed vessel may have, in the wall surface or bottom surface thereof, openings that can connect to a below-described exhaust pipe, water vapor supply pipe, gas introducing pipe, drain pipe and the like. The inside of the closed vessel can reach a closed state by closing valves provided in those pipes. The closed vessel may include a below-described heating section as long as the inside of the closed vessel can reach the closed state.

A plated steel sheet includes a base steel sheet and a hot-dip Al and Mg-containing Zn-plating layer formed on the surface of the base steel sheet.

Any steel sheet can be used as a base steel sheet. A steel sheet made of low carbon steel, medium carbon steel, high carbon steel, alloy steel, or the like can be used as the base steel sheet. When satisfactory press formability is required, a deep drawing steel sheet made of low carbon Ti-added steel, low carbon Nb-added steel, or the like is preferred as the base steel sheet. A high strength steel sheet containing P, Si, Mn, or the like may also be used.

The hot-dip Al and Mg-containing Zn-plating layer may have a composition such that the layer blackens upon contact with water vapor. Although the mechanism in which a plating layer blackens upon contact with water vapor still remains elusive, a hypothesis can be deduced as follows. Upon contact with water vapor, oxides of Zn, Al and/or Mg (e.g., $ZnO_{1-x}$ and $Al_2O_{3-x}$) that have oxygen-deficient defect structures are generated on the surface of or in the plating layer, thereby blackening the plating layer. When such oxygen-deficient oxides are generated, light is trapped in their defect levels to give black appearance to the oxides.

A plating layer, for example, having a composition of 0.1 mass % or more and 60 mass % or less of Al, 0.01 mass % or more and 10 mass % or less of Mg, and the balance of Zn can suitably blacken upon contact with water vapor. Setting the content of Al or Mg to the above upper limit value or less reduces the generation of dross during plating process, thereby making the appearance of the plating layer more beautiful. Setting the content of Al to the above lower limit value or more, meanwhile, can improve the adhesion of the plating layer. Setting the content of Mg to the above lower limit value or more can shorten the time for blackening the plating layer.

Herein, the content value of each component, expressed in percentage, in the plating layer represents the mass of each metal component contained in the plating layer divided by the total mass of metals contained in the plating layer. That is, the mass of oxygen and hydrogen contained in oxides and/or hydrated oxides generated by water vapor treatment is not included in the component content in the plating layer. Therefore, unless metal components are eluted during the water vapor treatment, the content of each component in the plating layer does not change before and after the water vapor treatment.

The most distributed hot-dip Al and Mg-containing Zn-plated steel sheets contain about 6 mass % of Al and about 3 mass % of Mg in its plating layer. In the case of such a plating composition, the metal structure of the plating layer has mainly a primary crystal of Al phase and ternary eutectic structure of $Al/Zn/Zn_2Mg$ mixed therein. Respective phases (Al phase, Zn phase, and $Zn_2Mg$ phase) that form the $Al/Zn/Zn_2Mg$ ternary eutectic structure each have an irregular size and shape, and are entangled one another. The primary crystal of Al phase and the Al phase in the ternary eutectic structure of $Al/Zn/Zn_2Mg$ are derived from an Al" phase (Al solid solution that makes a solid solution with Zn and includes a small amount of Mg) at a high temperature in an Al—Zn—Mg ternary equilibrium diagram. The Al" phase at a high temperature usually appears as fine Al phase and fine Zn phase separately at normal temperature. The Zn phase in the ternary eutectic structure is a Zn solid solution that makes a solid solution with a small amount of Al, and in some cases, further makes a solid solution with Mg. The $Zn_2Mg$ phase in the ternary eutectic structure is an intermetallic compound phase that is present near the point where Zn accounts for about 84 mass % in a Zn—Mg binary equilibrium diagram.

For improving the adhesion of the plating layer to the base steel sheet, the plating layer may contain 0.005 mass % or more and 2.0 mass % or less of Si. Setting the content of Si in the plating layer to 0.005 mass % or more can suppress the growth of an Al—Fe alloy layer at an interface of the base steel sheet and the plating layer, thereby further increasing the adhesion. Setting the content of Si in the plating layer to 2.0 mass % or less can reduce the generation of a Si-based oxide in the surface of the plating layer, thereby reducing the inhibition of blackening by such a Si-based oxide. For suppressing an adverse influence on the appearance and the corrosion resistance caused by the excessive generation and growth of a $Zn_{11}Mg_2$ phase, the plating layer may contain Ti, B, Ti—B alloy, a Ti-containing compound, or a B-containing compound. The content of those compounds in the plating layer is preferably set so that the amount of Ti is 0.001 mass % or more and 0.1 mass % or less, and the amount of B is 0.0005 mass % or more and 0.045 mass % or less. Setting the content of Ti and B in the plating layer to the above lower limit values or more can further suppress the generation and growth of the $Zn_{11}Mg_2$ phase. Setting the content of Ti and B in the plating layer to the above upper limit values or less can reduce the possibility of the growth of a precipitate in the plating layer. The presence of Ti, B, Ti—B alloy, Ti-containing compound, or B-containing compound in the plating layer gives only ignorable influence on blackening by water vapor treatment.

The plating layer may have any thickness which is preferably 3 μm or more and 100 μm or less. A plating layer having a thickness of 3 μm or more is more likely to prevent a scratch to reach the base steel sheet during the handling of the sheet, thereby improving an ability to maintain black appearance and corrosion resistance. A plating layer having a thickness of 100 μm or less, meanwhile, is less likely to separate from the base steel sheet in a processed part thereof caused by the difference in the ductility between the plating layer and the base steel sheet when subjected to compression.

The plated steel sheet may have any shape as long as a region to be blackened by the water vapor treatment in the plated steel sheet can be brought into contact with water vapor. As for the shape of the plated steel sheet, the plated surface thereof may be in a flat shape (e.g., a flat plate shape), or in a curved shape (e.g., a coil shape). The coil shape refers to a shape of a metal strip composed of a plated steel sheet which is wound and spaced apart radially. The shape of the plated steel sheet is preferably in a coil shape since it is easier to be disposed inside the closed vessel, and easier to be conveyed after the treatment. For easy intrusion of water vapor, the space of the coil is preferably set so that the shortest distance between the two adjacent surfaces in the radial direction is 0.05 mm or more.

The space between the surfaces of the coil-shaped plated steel sheet can be provided by, for example, disposing a spacer between the surfaces of the wound plated steel sheet. The spacer may have any shape as long as it enables water vapor to spread to cover the entire coil-shaped plated steel sheet, and maybe a linear spacer or a planar spacer. The linear spacer is a linear member disposed in a part of the surface of the plated steel sheet. The planar spacer is a flat-plate shaped member disposed at least in a part of the surface of the plated steel sheet. The area of a region where the steel sheet is in contact with the spacer is smaller the better, and the contact area at one contact point is preferably 15 $mm^2$ or less. Any material may be used as the spacer as long as it does not significantly deteriorate, ignite, or cause fusing or melting with a plated steel sheet during the water vapor treatment. As the material, a metal or a resin is preferred, and a material permeable to water vapor is more preferred.

For forming a part not to be blackened on the surface of a plated steel sheet, a masking tape, such as an aluminum tape or a resin tape, which has a shape of the not-to-be blackened part may be provided on a part of the surface.

Single plated steel sheet, or stacked plated steel sheets may be disposed inside the closed vessel. The coil-shaped plated steel sheet may be disposed, for example, eye up (with eyes vertical, i.e., with the coil end facing upward). For blackening two or more coil-shaped plated steel sheets simultaneously, the two or more coil-shaped plated steel sheets each may be disposed eye up inside the closed vessel, and may be stacked one another. In the above case, the plated steel sheets are also preferably disposed or stacked so that the shortest distance between the two adjacent surfaces becomes 0.05 mm or more for easy intrusion of water vapor. The space between plated steel sheets can also be provided by, for example, disposing a spacer between the adjacent plated steel sheets. Alternatively, a plated steel sheet processed into any given shape may be blackened, and in such a case, the processed plated steel sheet may be disposed on a shelf, serves as the disposition section, provided inside the closed vessel, or may be suspended from the shelf.

The plated steel sheet is heated in the presence of a gas having a dew point which is always lower than the temperature of the plated steel sheet (low water vapor gas). In other words, the atmospheric gas present inside the closed vessel is a low water vapor gas in the present step. For easier operation, the low water vapor gas is preferably air, or may be an inert gas as long as the blackening is possible. Examples of the inert gases include Ar, $N_2$, He, Ne, Kr, $H_2$, Xe, and mixtures thereof. Ar, $N_2$, He and the mixture of $N_2$ and $H_2$ which are available at low cost are preferred. The low water vapor gas can be introduced into the closed vessel from a below-described gas introducing section.

The temperature of the plated steel sheet before heating is usually at around normal temperature. In addition, the heat capacity of a plated steel sheet is large. Therefore, when a plated steel sheet is heated in the presence of a gas having a dew point higher than the temperature of the plated steel sheet, namely a gas containing a high amount of water vapor, as in a conventional method, the atmospheric gas in the periphery of the surface of the plated steel sheet is cooled by the plated steel sheet to condense water vapor, thereby possibly generating dewdrops on the surface of the plated steel sheet. Generation of the dewdrops on the surface of the plated steel sheet prevents water vapor from contacting the parts where the dewdrops are generated, thereby preventing the blackening, and thus the plating layer cannot be uniformly blackened in some cases. Further, such dewdrops may corrode the surface of the plated steel sheet, and destroy the appearance by covering the surface with white rust. The method of the present invention, on the other hand, heats a plated steel sheet in the presence of a low water vapor gas, and thus less likely to generate dewdrops from the condensation of water vapor. The method of the present invention therefore can blacken the plating layer more uniformly and obtain more beautiful appearance of the plated steel sheet. From the above view point, in the present step, the dew point of the atmospheric gas is more preferably at normal temperature or less, and the atmospheric gas may be, for example, air. As the temperature of a plated steel sheet increases during the heating, when the dew point of the atmospheric gas at the beginning of the heating is lower than the temperature of the plated steel sheet, usually, the dew point of the atmospheric gas remains lower than the temperature of the plated steel sheet.

The heating is continued until the surface temperature of the plating layer reaches a temperature at which the plating layer is satisfactorily blackened (hereinafter, also simply referred to as a "blackening treatment temperature") upon contacting water vapor. The heating may be, for example, performed while measuring the surface temperature of the plating layer using a temperature measurement sensor disposed inside a closed vessel, and ended when the temperature of the plating layer exceeds the blackening treatment temperature.

Since the heat capacity of a plated steel sheet is large, the surface temperature may not uniformly increase, and become uneven. Therefore, preferably, the heating is performed while measuring the temperature for a plurality of points or regions on the surface of the plating layer, or for the entire surface, and continued until the temperature of the point or region whose measured temperature is the lowest (hereinafter, also simply referred to as a "lowest-temperature point") reaches the blackening treatment temperature. By accumulating the measured data, the heating step can be ended only by setting the conditions without actual measurement of the temperature.

The blackening treatment temperature may be set to any temperature in accordance with the composition of the plating layer (e.g., the amounts of Al and Mg in the plating layer), thickness thereof, required brightness and/or the like, and preferably 50° C. or more and 350° C. or less, and more preferably 105° C. or more and 200° C. or less. Setting the blackening treatment temperature to 105° C. or more can shorten the time for blackening. Setting the blackening treatment temperature to 350° C. or less, meanwhile, can prevent a blackening apparatus from becoming larger, and reduce the energy consumption for heating water vapor, as well as easily control the blackening degree of the plating layer.

Any heating method may be employed as long as the surface of a plating layer can reach the blackening treatment temperature. For example, the heating may be performed using a heating section disposed between an inner cover and an outer cover of a closed vessel, or by introducing hot air into the closed vessel. For uniformly heating the plated steel sheet, the heating may be performed while stirring the atmospheric gas inside the closed vessel.

(Step 2)

In Step 2 (S120), the atmospheric gas inside the closed vessel is exhausted to reduce the gas pressure inside the closed vessel to 70 kPa or less. The gas pressure inside the closed vessel becomes a value within the above range by, for example, exhausting the atmospheric gas in the closed vessel to expel the gas from the closed vessel using an exhaust pump disposed outside the closed vessel. In the present step, the exhausting of the atmospheric gas may be performed once, or alternatively, the exhausting of the atmospheric gas and introducing of a low water vapor gas may be repeated for further reducing the amount of gas components remained inside the closed vessel other than water vapor.

In the present step, the method of the present invention reduces the gas pressure inside the closed vessel by exhausting the atmospheric gas therein, thereby satisfactorily filling the gaps between the plated steel sheets with water vapor introduced in below-described Step 3 (S130). This enables more uniform water vapor treatment over the entire plating layer to be blackened, and thus uneven blackening is less likely to be generated. Further, the exhausting in the present step can reduce the oxygen concentration in the closed vessel after the introduction of water vapor in Step 3 to 13% or less. From the above view point, in the present step, the gas pressure inside the closed vessel is preferably reduced to 70 kPa or less, and more preferably to 50 kPa or less.

(Step 3)

In Step 3 (S130), water vapor is introduced into the inside of the closed vessel to blacken the plating layer.

For performing the blackening uniformly in the present step, when a point or region, whose measured temperature is the highest is referred to as a "highest-temperature point," Step 3 (S130) is preferably performed after a temperature difference between the lowest-temperature point and the highest-temperature point, among a plurality of points or regions on the surface of the plating layer or in the entire surface thereof, becomes 30° C. or less, preferably 20° C. or less and more preferably 10° C. or less. From the above view point, Step 3 (S130) is more preferably performed when the temperatures of the highest-temperature point and the lowest-temperature point become substantially the same. For allowing the temperature difference to fall within the above range, a temperature-uniformizing step in which a plated steel sheet is left to stand for uniformizing the temperature on the surface of the plating layer may be provided between Steps 1 and 2, or Steps 2 and 3.

The inside of the closed vessel during the water vapor treatment preferably has an atmospheric temperature of 105° C. or more, and relative humidity of 80% or more and 100% or less. Setting the atmospheric temperature to 105° C. or more, and relative humidity to 80% or more can shorten the time for blackening. Further, setting the atmospheric temperature to 105° C. or more can satisfactorily blacken the plating layer to, for example, lower the lightness L* value of the plating layer in the L*a*b* color space to 60 or less, preferably 40 or less, and more preferably 35 or less. The lightness (L* value) of the plating layer surface is measured by a spectral reflection measuring method using a spectroscopic color-difference meter. By setting the atmospheric temperature to 105° C. or more, the moisture becomes less likely to condense, thereby suppressing the generation of the dewdrops in the inside of the closed vessel or on the surface of the plating layer. The atmospheric temperature is more preferably 105° C. or more and 350° C. or less, and even more preferably 105° C. or more and 200° C. or less. It is more preferred that the relative humidity is substantially 100%. The inside of the closed vessel during the water vapor treatment preferably has an oxygen concentration of 13% or less. Setting the oxygen concentration to 13% or less can suppress the generation of uneven blackening.

For maintaining the atmospheric temperature, the inside of the closed vessel may be heated in the present step. Any heating method may be employed as long as the temperature and the relative humidity inside the closed vessel are controlled to fall within the above ranges. For example, the inside of the closed vessel can be heated by activating a below-described heating section, or heating the water vapor to be introduced.

Any current technology finds it difficult to directly measure relative humidity, a dew point and a partial pressure of water vapor in the atmosphere exceeding 100° C. In the present step, the inside of the closed vessel is filled substantially only with water vapor once the introduction of water vapor starts. The relative humidity inside the closed vessel can be thus obtained by dividing a value of a pressure gauge that can monitor inside the closed vessel, by a saturated water vapor pressure at the temperature at that time. However, once the plating layer starts blackening, hydrogen gas (i.e., reaction by-product of a metal of the plating layer and water vapor) is generated, and thus the gas pressure inside the closed vessel measured using the pressure gauge becomes the total pressure, the sum of partial pressures of water vapor and hydrogen inside the closed vessel. The hydrogen gas mixed into the atmospheric gas inside the closed vessel during the water vapor treatment may reduce the relative humidity to fall out of the above preferred range. For maintaining the relative humidity, after introducing water vapor into the closed vessel in the present step, a predetermined amount of the atmospheric gas may be expelled from the inside of the closed vessel, and water vapor may further be introduced into the closed vessel. In the present step, expelling a predetermined amount of the atmospheric gas from the inside of the closed vessel and further introducing water vapor into the closed vessel can prevent increment of the concentration of the hydrogen gas inside the closed vessel, and thus the present step can be performed while the relative humidity remains in the above preferred range. It is preferred that the amount of the further introduced water vapor is the same as the amount of the expelled gas. The expelling of the atmospheric gas and the introducing of water vapor may be continued from the start to the end of the present step, performed once, or performed more than once at regular intervals. As long as a plating layer is blackened to a desired degree, the present step may be performed without the expelling of the atmospheric gas from the inside of the closed vessel and the introducing of water vapor into the closed vessel.

Step 3 is preferably performed in a closed state except for the introducing of water vapor and the expelling of the atmospheric gas, for maintaining the atmospheric temperature and the relative humidity.

Further, for allowing the entire inside of the closed vessel to have a relative humidity in the above range, thereby preventing uneven blackening, the present step may include stirring of the atmospheric gas inside the closed vessel during the blackening of the plating layer after the introducing of water vapor into the closed vessel.

The water vapor treatment may be performed for any period of time in accordance with the composition of the plating layer (e.g., the amounts of Al and Mg in the plating layer), thickness thereof, required brightness and/or the like.

(Step 4)

In Step 4 (S140), the atmospheric gas inside the closed vessel is exhausted to reduce the gas pressure inside the closed vessel to 70 kPa or less. The pressure inside the closed vessel can be reduced by, for example, expelling the atmospheric gas inside the closed vessel using an exhaust pump disposed outside the closed vessel, thereby exhausting the atmospheric gas.

When the plated steel sheet is cooled while water vapor still remains inside the closed vessel in below-described Step 5 (S150), water vapor remaining, for example, in the gaps between the plated steel sheets is cooled and condensed, thereby generating dewdrops on the surface of the plating layer or in the closed vessel in some cases. Generation of the dewdrops on the surface of the plating layer in the present step results in the deposition of moisture on the surface of a black-plated steel sheet, and thus the blackness of the plated steel sheet may become uneven. The method of the present invention, on the other hand, cools the plated steel sheet after the atmospheric gas inside the closed vessel is exhausted and thus the amount of water vapor inside the closed vessel is reduced. Therefore, dewdrops are less likely to be generated. From the above view point, in the present step, the gas pressure inside the closed vessel is preferably reduced to 70 kPa or less, and more preferably to 30 kPa or less.

(Step 5)

In Step 5 (S150), a gas having a dew point which is always lower than the temperature of the plated steel sheet is introduced into the closed vessel to cool the plated steel sheet. The to-be introduced gas in the present step is preferably not heated, but may be heated to a temperature lower than the atmospheric temperature inside the closed vessel as necessary.

The to-be introduced gas in the present step may be, for example, an inert gas or air. The to-be introduced gas in the present step may be the same as, or different from the low water vapor gas in the above Step 1. For easier operation, it is preferred that the closed vessel is opened to air for introducing the air thereto.

(Effects)

The method of the present invention enables satisfactory filling of the gaps between the plated steel sheets with water vapor, as well as reduction of the generation of dewdrops on the surface of the plated steel sheets, and thus a region to be blackened in the plated steel sheets can be more uniformly blackened.

2. Apparatus for Producing Black-Plated Steel Sheet (Configuration of Apparatus)

Figure 3:
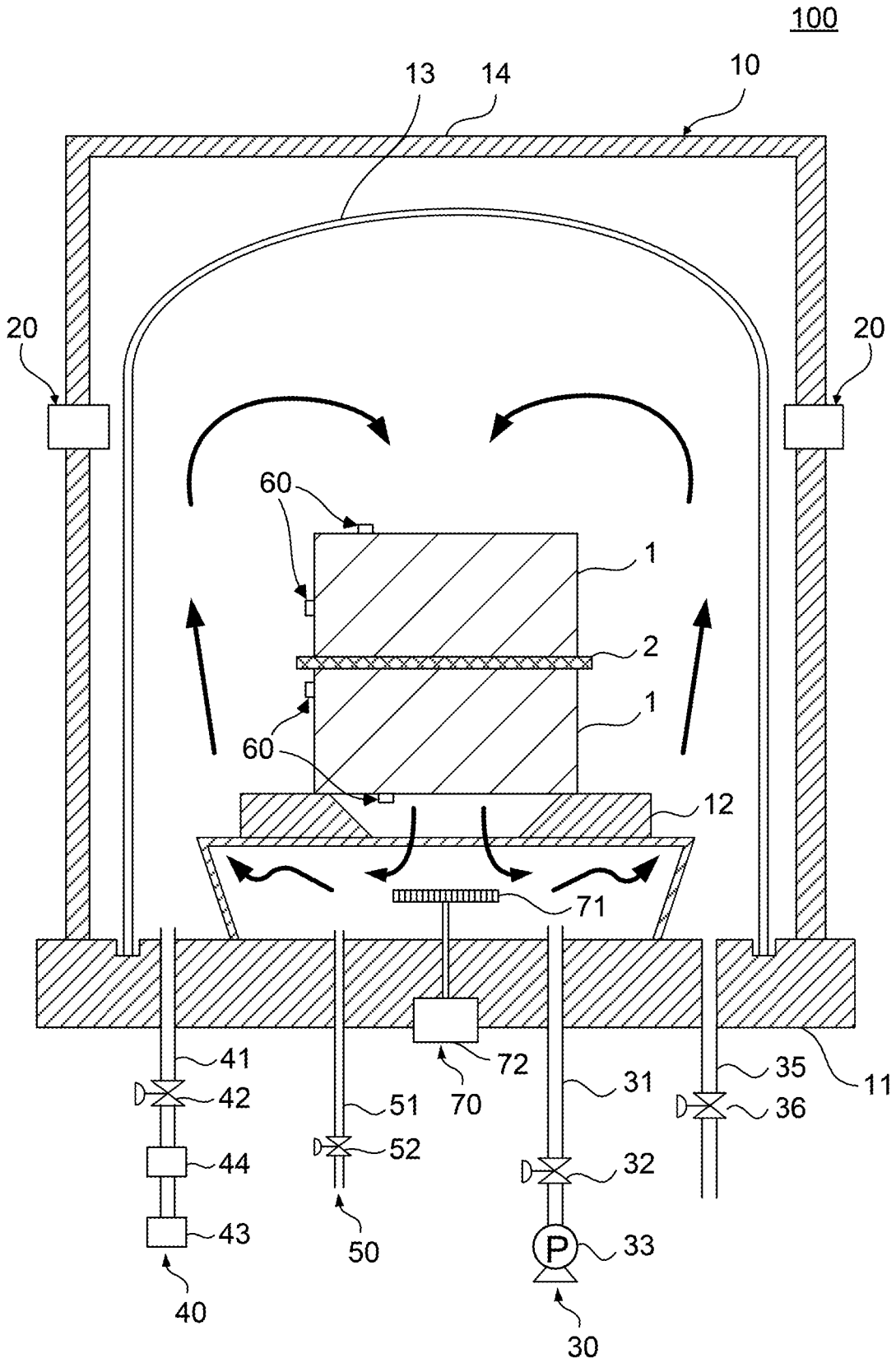
FIG. 3 is a schematic cross-sectional view for illustrating an example of an apparatus according to the present invention for producing a black-plated steel sheet.
Figure 4:
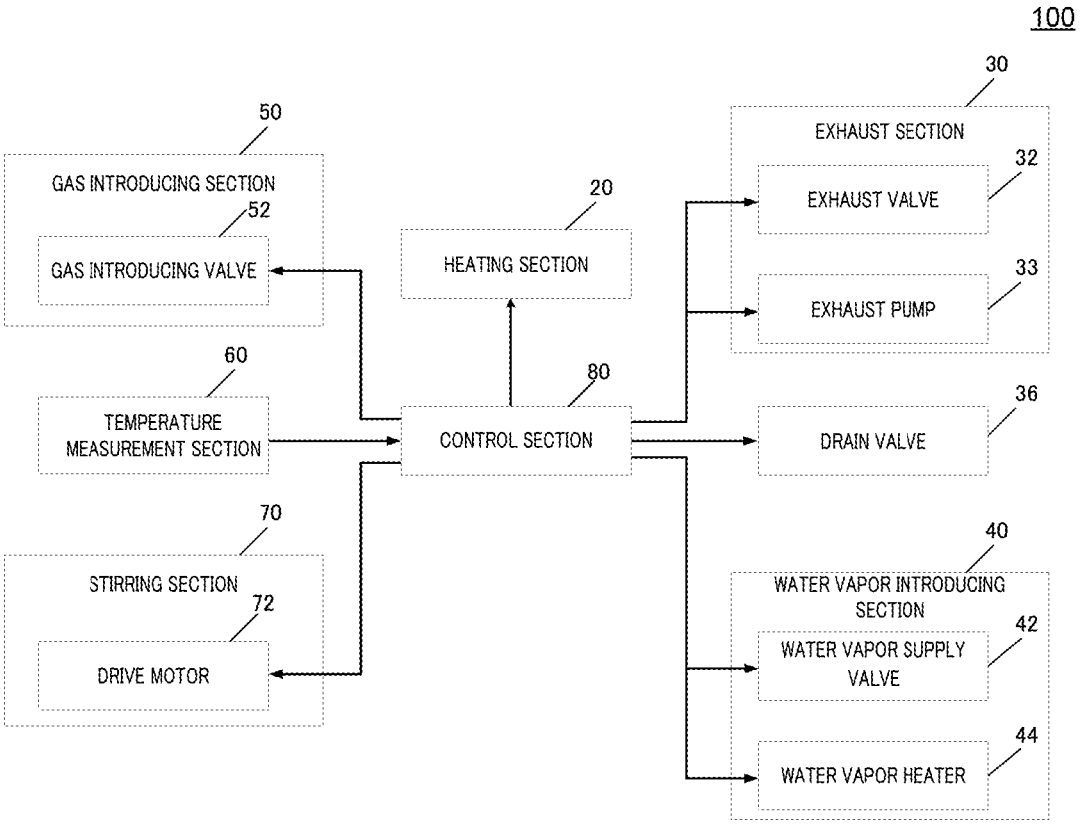
FIG. 4 illustrates an example of a principal part of a control system in a system according to the present invention for producing a black-plated steel sheet.

Apparatus 100 according to the present invention for producing the black-plated steel sheet (hereinafter, also simply referred to as an "apparatus of the present invention") includes, as illustrated in FIG. 3, namely the schematic cross-sectional view illustrating an example, closed vessel 10 including disposition section 12 where plated steel sheet 1 can be disposed in a removable manner, heating section 20 for heating the inside of the closed vessel, exhaust section 30 for exhausting the atmospheric gas inside the closed vessel, and water vapor introducing section 40 for introducing water vapor into the closed vessel. Apparatus 100 of the present invention may further include gas introducing section 50 for introducing a gas into the closed vessel, temperature measurement section 60 for measuring the surface temperature of plated steel sheet 1, and/or stirring section 70 for stirring the atmospheric gas inside closed vessel 10. Apparatus 100 of the present invention may further include, as illustrated in FIG. 4, control section 80 for controlling the operations of heating section 20, exhaust section 30 and water vapor introducing section 40 to bring plated steel sheet 1 into contact with water vapor inside the closed vessel, thereby producing a black-plated steel sheet. When apparatus 100 of the present invention includes gas introducing section 50 or stirring section 70, control section 80 may control the operation of gas introducing section 50 for cooling the black-plated steel sheet, or the operation of stirring section 70 for stirring the atmospheric gas inside closed vessel 10. When apparatus 100 of the present invention includes below-described drain pipe 35 and drain valve 36, control section 80 may control the operation of drain valve 36 for expelling water in the inside of the apparatus to the outside.

Apparatus 100 of the present invention may further include a gas expelling section (not illustrated) for expelling a predetermined amount of gas from the inside of closed vessel 10 during the blackening of a plating layer after the introduction of water vapor into closed vessel 10. Exhaust section 30 may also act as the gas expelling section. Apparatus 100 of the present invention may further include drain pipe 35 and drain valve 36 for expelling to the outside of the system dew water generated from condensation of water vapor in the apparatus other than the steel sheet, after the introduction of the water vapor.

Hereinafter, an exemplified mode of apparatus 100 of the present invention will be described in detail with reference to FIGS. 3 and 4.

Closed vessel 10 includes bottom frame 11, disposition section 12, inner cover 13 and outer cover 14. Bottom frame 11 is a member constituting the bottom of closed vessel 10. Disposition section 12 is a member having a shape and size that enable disposition of plated steel sheet 1. Inner cover 13 is a member which has a substantially U-shaped cross section, and is disposed on bottom frame 11 so as to cover bottom frame 11. Outer cover 14, larger than inner cover 13, is a member which has a substantially U-shaped cross section, and is disposed on bottom frame 11 so as to cover the outer surface of inner cover 13. Fitting inner cover 13 into a groove provided in bottom frame 11 seals a space enclosed with inner cover 13 and bottom frame 11 (hereinafter, also simply referred to as an "inside of closed vessel 10"). Closed vessel 10 has a strength sufficient for enduring the inside gas pressure reduction due to the exhausting of the atmospheric gas, the inside pressure elevation due to the introduction of water vapor, heating, cooling, and the like.

Bottom frame 11 or inner cover 13 may include, in the bottom surface or wall surface thereof, an opening capable of connecting to below-described exhaust pipe 31, water vapor supply pipe 41, gas introducing pipe 51 and/or the like. In such a case, the inside of the closed vessel can reach a closed state by closing a valve provided in the pipe.

Disposition section 12 may have any shape as long as the disposition of plated steel sheet 1 is possible, and may be a base disposed on bottom frame 11 as illustrated in FIG. 3, or a shelf-shaped member on which a plated steel sheet can be disposed or from which a plated steel sheet can be suspended.

Disposition section 12 is a section where plated steel sheet 1 is disposed. For example, coil-shaped plated steel sheet 1 may be disposed on disposition section 12 so that the axis of the coil is along the vertical direction (eye-up). Plated steel sheets 1 may be stacked with spacer 2 therebetween. Alternatively, a plated steel sheet processed into any given shape may be disposed on the shelf-shaped member, or suspended from the shelf-shaped member.

Plated steel sheet 1 having a part not to be blackened, if any, is preferably disposed on disposition section 12 so that the surface including the not-to-be blackened part is in contact with disposition section 12.

In the surface of disposition section 12 where plated steel sheet 1 is disposed, through holes are formed so that gaps between metal strips of plated steel sheet 1 communicate with the inside of disposition section 12. The inside of disposition section 12 is formed in a hollow state so that the through holes communicate with the outside of disposition section 12. In FIG. 3, for example, disposition section 12 is composed of an upper base and lower base. The upper base includes a flow path for blowing to the periphery of impeller 71 the atmospheric gas which flows from the underside of plated steel sheet 1 into the inside of disposition section 12, and the lower base include through holes communicating with the upper base. Such a configuration is preferred since the gas inside closed vessel 10 is circulated through the gaps between metal strips of plated steel sheet 1 and stirred, thereby bringing plated steel sheet 1 into contact with the atmospheric gas having more uniform relative humidity.

Heating section 20 is a means for heating the inside of closed vessel 10. Heating section 20 is, for example, composed of blowers which are disposed at intervals along the circumferential direction of outer cover 14. Each blower is configured to be able to blow hot wind into a space formed between outer cover 14 and inner cover 13. The means for heating the inside of closed vessel 10 is not limited to heating section 20, and may be a method that heats a plated steel sheet by directly introducing heated air into inner cover 13, or a method in which an IH heater is installed under a plated steel sheet to heat the steel sheet as well as the inner atmosphere of inner cover 13.

Exhaust section 30 includes exhaust pipe 31, exhaust valve 32 and exhaust pump 33. Exhaust pipe 31 is a pipe provided so as to go through bottom frame 11 and allow for the communication between the inside and the outside of closed vessel 10. For example, the low water vapor gas inside closed vessel 10, or the atmospheric gas inside closed vessel 10 after the water vapor treatment is exhausted to outside through exhaust pipe 31. Exhaust pipe 31 communicates with exhaust pump 33 via exhaust valve 32. Exhaust section 30 is configured to be able to reduce the gas pressure inside the closed vessel to 70 kPa or less by the exhausting of the atmospheric gas. While the exhausting is not performed, exhaust valve 32 is closed, and the gas flow between the inside and the outside of closed vessel 10 through exhaust pipe 31 is cut off.

Drain pipe 35 is a pipe provided so as to go through bottom frame 11 and allow for the communication between the inside and the outside of closed vessel 10. Liquid (e.g., dew water) inside closed vessel is expelled to the outside through drain pipe 35. For easier expelling of a larger amount of liquid, the opening of the drain pipe is preferably provided in a position the same as or lower than that of bottom frame 11. Drain pipe 35 communicates with the outside of closed vessel via drain valve 36. While the liquid expelling is not performed, drain valve 36 is closed, and the liquid flow between the inside and the outside of closed vessel 10 through drain pipe 35 is cut off.

Water vapor introducing section 40 includes water vapor supply pipe 41 and water vapor supply valve 42, and optionally water vapor heater 44 and water vapor supply source 43 composed of a water storage tank and a heater. Water vapor supply pipe 41 allows for, for example, the communication between water vapor supply source 43 and the inside of closed vessel 10 via water vapor supply valve 42. Water vapor heater 44 heats water vapor so that the temperature of to-be-introduced water vapor reaches the atmospheric temperature inside closed vessel 10 during the water vapor treatment. While the vapor supply is not performed, water vapor supply valve 42 is closed, and the introduction of water vapor into closed vessel 10 through water vapor supply pipe 41 is cut off. When using water vapor produced with another apparatus, the pressure of the supplied water vapor may be controlled using water vapor supply valve 42 so that the inside of the closed vessel has predetermined relative humidity.

Gas introducing section 50 includes gas introducing pipe 51 and gas introducing valve 52. Gas introducing pipe 51 is a pipe provided so as to go through bottom frame 11 and allow the inside of closed vessel 10 to communicate with the outside of closed vessel 10 or a gas supply source (not illustrated). Opening of gas introducing valve 52 introduces into closed vessel 10 through gas introducing pipe 51 a gas, supplied from the gas supply source, having a dew point which is always lower than the temperature of the plated steel sheet, or air outside closed vessel 10. While the gas introduction is not performed, gas introducing valve 52 is closed, and the gas flow between the inside and the outside of closed vessel 10 through gas introducing pipe 51 is cut off.

Temperature measurement section 60 is composed of a plurality of temperature sensors respectively attached on different regions on the surface of a plated steel sheet. Temperature measurement section 60 may be, for example, thermocouples. Temperature measurement section 60 measures the surface temperature of the plated steel sheet. On using a coil-shaped plated steel sheet, the thermocouple may be inserted between the sheets of the coil.

Stirring section 70 includes impeller 71 disposed inside inner cover 13, and drive motor 72 for rotationally driving impeller 71. When drive motor 72 rotates impeller 71, as illustrated with arrows in FIG. 3, the atmospheric gas inside closed vessel 10 during the water vapor treatment is circulated inside closed vessel 10 in such a manner that the atmospheric gas flows into the clearance between the outer peripheral surface of disposition section 12 and the inner wall surface of inner cover 13 from the side of disposition section 12, passes through the clearance between the outer peripheral surface of plated steel sheet 1 and the inner wall surface of inner cover 13, flows to the gaps between metal strips of plated steel sheet 1 from the top thereof, flows from the underside of plated steel sheet 1 into the inside of disposition section 12, and again flows into the clearance between the outer peripheral surface of disposition section 12 and the inner wall surface of inner cover 13 from the side of disposition section 12. The atmospheric gas inside closed vessel 10 during the water vapor treatment is thus stirred by the circulation.

The atmospheric gas inside closed vessel 10 may be stirred by stirring section 70 during the heating of a plated steel sheet using heating section 20.

Control section 80 controls the operation of apparatus 100 of the present invention as described below.

3. System for Producing Black-Plated Steel Sheet

Hereinafter, an exemplified operation of apparatus 100 of the present invention and a system for producing a black-plated steel sheet will be described in detail with reference to FIGS. 3 and 4.

After the disposing of plated steel sheet 1 on disposition section 12 and the sealing of closed vessel 100 by fixing inner cover 13 and outer cover 14 to bottom frame 11, control section 80 controls the operations of heating section 20, exhaust section 30, water vapor introducing section 40, gas introducing section 50 and stirring section 70 as follows.

Heating section 20 blows hot wind into a space formed between outer cover 14 and inner cover 13 to heat the inside the closed vessel in the presence of a low water vapor gas, thereby heating plated steel sheet 1. During the heating, control section 80 refers to a predetermined temperature for the water vapor treatment of the plated steel sheet, and controls heating section 20 to operate until the temperature of the plating layer (preferably of the lowest-temperature point) measured using temperature measurement section 60 becomes the above described blackening treatment temperature or more. As necessary, stirring section 70 may stir and circulate the atmospheric gas inside the inner cover 13 by driving drive motor 72 to rotate impeller 71 during the heating using heating section 20.

Subsequently, exhaust section 30 opens exhaust valve 32 and activates exhaust pump 33, thereby expelling the atmospheric gas inside closed vessel 10 through exhaust pipe 31. This operation reduces the gas pressure inside closed vessel 10 to 70 kPa or less (first exhaustion). Exhaust section 30 then closes exhaust valve 32 to cut off the gas flow between the inside and the outside of closed vessel 10 through exhaust pipe 31.

Subsequently, water vapor introducing section 40 opens water vapor supply valve 42 to allow for water vapor supply from water vapor supply source 43. This operation introduces water vapor from water vapor supply source 43 into closed vessel 10 through water vapor supply pipe 41. Water vapor introducing section 40 preferably opens water vapor supply valve 42 after control section 80 recognizes that the difference between temperatures of the highest-temperature point and the lowest-temperature point measured using temperature measurement section 60 is reduced to fall within a predetermined range. Water vapor heater 44 may heat to-be-introduced water vapor.

Water vapor introducing section 40 may have water vapor to be introduced into closed vessel 10 heated using water vapor heater 44, as necessary. Stirring section 70 may circulate and stir the atmospheric gas inside closed vessel 10 by driving drive motor 72 to rotate impeller 71, as necessary.

The gas expelling section (not illustrated) or exhaust section 30 may expel only a predetermined amount of the atmospheric gas inside closed vessel 10, as necessary. During the operation, water vapor supply valve 42 is opened so that water vapor is introduced into closed vessel 10 in the same amount as the expelled atmospheric gas.

Once sufficient time for blackening treatment passes after the introduction of water vapor, water vapor introducing section 40 closes water vapor supply valve 42 to cut off the gas flow between the inside and the outside of closed vessel 10 through water vapor supply pipe 41. Subsequently, exhaust section 30 opens exhaust valve 32 to allow exhaust pump 33 to expel the atmospheric gas inside closed vessel 10, as necessary. This operation reduces the gas pressure inside the closed vessel to 70 kPa or less (second exhaustion). Exhaust section 30 then closes exhaust valve 32 to cut off the gas flow between the inside and the outside of closed vessel 10 through exhaust pipe 31.

Subsequently, gas introducing section 50 opens gas introducing valve 52. This operation introduces into closed vessel 10 through gas introducing pipe 51 a gas having a dew point which is always lower than the temperature of the plated steel sheet. The introduced gas cools plated steel sheet 1.

During the operations, liquid may be expelled from the inside to the outside of the apparatus by controlling the operation of drain valve 36 at any given time. The controlling of the operation of drain valve 36 may be performed once or more than once during the operation of apparatus 100 of the present invention. As long as a plating layer is blackened to a desired degree, however, drain valve 36 may be kept closed throughout the operations.

Effects

The apparatus and system of the present invention enable filling of the gaps between the plated steel sheets with water vapor, as well as reducing of the generation of dewdrops on the surface of the plated steel sheets, and thus a region to be blackened in the plated steel sheets can be more uniformly blackened.

This application claims priority based on Japanese Patent Application No. 2016-038848, filed on Mar. 1, 2016, the entire contents of which including the claims, the specification and the drawings are incorporated herein by reference.

INDUSTRIAL APPLICABILITY

The method of the present invention is capable of suppressing the generation of dewdrops during the heating of a plated steel sheet, and blackening a plating layer more uniformly to produce a black-plated steel sheet with more beautiful appearance. Therefore, the method of the present invention is expected to contribute to the more widely spread of black-plated steel sheets.

REFERENCE SIGNS LIST

1 Plated steel sheet
10 Closed vessel
11 Bottom frame
12 Disposition section
13 Inner cover
14 Outer cover
20 Heating section
30 Exhaust section
31 Exhaust pipe
32 Exhaust valve
33 Exhaust pump
35 Drain pipe
36 Drain valve
40 Water vapor introducing section
41 Water vapor supply pipe
42 Water vapor supply valve
43 Water vapor supply source
44 Water vapor heater
50 Gas introducing section
51 Gas introducing pipe
52 Gas introducing valve
60 Temperature measurement section
70 Stirring section
71 Impeller
72 Drive motor
80 Control section

The invention claimed is:

1. A method for producing a black-plated steel sheet by contacting a plated steel sheet with water vapor in a closed vessel, the plated steel sheet including a base steel sheet and a plating layer, the plating layer including a hot-dip Al and Mg-containing Zn-plating layer formed on a surface of the base steel sheet, the method comprising:

heating the plated steel sheet disposed in the closed vessel filled with a first gas having a dew point which is always lower than a temperature of the plated steel sheet;

after the heating of the plated steel sheet, reducing a gas pressure in the closed vessel to 70 kPa or less by exhausting a first atmospheric gas heated in the closed vessel;

after the reducing of the gas pressure by exhausting the first atmospheric gas, blackening the plating layer by introducing the water vapor into the closed vessel;

after the blackening of the plating layer, reducing the gas pressure in the closed vessel to 70 kPa or less by exhausting a second atmospheric gas in the closed vessel where the black-plated steel sheet having the plating layer blackened is disposed; and after the reducing of the gas pressure by exhausting the second atmospheric gas, cooling the plated steel sheet by introducing a second gas having a dew point which is always lower than the temperature of the plated steel sheet into the closed vessel.

2. The method according to claim 1, wherein the plated steel sheet is a coil-shaped plated steel sheet.

3. The method according to claim 2, wherein the coil-shaped plated steel sheet is disposed with the coil end facing upward in the closed vessel.

4. The method according to claim 2, wherein two or more of the coil-shaped plated steel sheets are each disposed with eyes vertical in the closed vessel, and the coil-shaped plated steel sheets are stacked.

5. The method according to claim 1, wherein the plated steel sheet is a processed plated steel sheet.

6. The method according to claim 1, wherein, in the heating, the first gas is air.

7. The method according to claim 5, wherein, in the heating, the plated steel sheet is heated while the first gas is stirred in the closed vessel.

8. The method according to claim 1, wherein, in the blackening, the inside of the closed vessel has an atmospheric temperature of 105° C. or more, and relative humidity of 80% or more.

9. The method according to claim 1, wherein, in the blackening, the inside of the closed vessel is heated.

10. The method according to claim 1, wherein, in the blackening after the introducing the water vapor into the closed vessel, a predetermined amount of the first atmospheric gas is expelled from the inside of the closed vessel, and another water vapor is further introduced into the closed vessel.

11. The method according to claim 1, wherein, in the blackening after the introducing the water vapor into the closed vessel, the first atmospheric gas in the closed vessel is stirred.

12. The method according to claim 1, wherein the hot-dip Al and Mg-containing Zn-plating layer contains 0.1 mass % or more and 60 mass % or less of Al, and 0.01 mass % or more and 10 mass % or less of Mg.

* * * * *